United States Patent [19]

Datye et al.

[11] 4,081,240

[45] Mar. 28, 1978

[54] PROCESS FOR DYEING FULLY SYNTHETIC TEXTILE MATERIAL

[75] Inventors: Keshav Vinayak Datye; Purushottam J. Kangle, both of Goregaon-Bombay, India; Branimir Milicevic, Riehen, Switzerland; Alfred Litzler, Itingen, Switzerland; Eugen Johann Koller, Oberwil, Switzerland

[73] Assignee: Ciba-Geigy AG, Basel, Switzerland

[21] Appl. No.: 587,491

[22] Filed: Jun. 16, 1975

Related U.S. Application Data

[63] Continuation of Ser. No. 421,890, Dec. 5, 1973, abandoned, which is a continuation of Ser. No. 221,077, Jan. 26, 1972, abandoned, which is a continuation of Ser. No. 109,956, Jan. 26, 1971, abandoned, which is a continuation-in-part of Ser. No. 762,145, Sep. 24, 1968, abandoned.

[51] Int. Cl.[2] ..... D06P 3/54

[52] U.S. Cl. ..... 8/94 A; 8/85 B; 8/166; 8/172 R; 8/172 A; 8/173; 8/174; 8/175; 8/179

[58] Field of Search ..... 8/221, 077, 109, 956, 8/421, 890, 166, 173, 174, 172 R, 172 A, 85 B, 175, 179, 94 A

[56] References Cited

U.S. PATENT DOCUMENTS

| | | | |
|---|---|---|---|
| 3,098,691 | 7/1963 | Pascal | 8/55 |
| 3,241,906 | 3/1966 | Smith et al. | 8/55 |
| 3,510,243 | 5/1970 | Seuret et al. | 8/39 |
| 3,667,898 | 6/1972 | Bergman et al. | 8/94 |

FOREIGN PATENT DOCUMENTS

| | | |
|---|---|---|
| 1,483,030 | 9/1968 | France. |

OTHER PUBLICATIONS

Dyeing and Chemical Technology of Textile Fibres, E. R. Trotman, 3rd Ed., 1964.

*Primary Examiner*—John Kight, III
*Attorney, Agent, or Firm*—Edward McC. Roberts; Prabodh I. Almaula

[57] ABSTRACT

A process for dyeing textile material of fully synthetic polymers ready for weaving by the exhaustion method, wherein dyeing is carried out at a temperature of at least 70° C in a homogenous solution of one or several dyestuffs in a hydrophobic or hydrophilic solvent or solvent mixture, any sulphur atoms present in the solvent or solvent mixture being divalent or hexavalent.

7 Claims, No Drawings

PROCESS FOR DYEING FULLY SYNTHETIC TEXTILE MATERIAL

CROSS REFERENCE TO RELATED APPLICATIONS

This application is a continuation of application Ser. No. 421,890, filed Dec. 5, 1973 (now abandoned) which is a continuation of application Ser. No. 221,077, filed on Jan. 26, 1972 (now abandoned), which is a continuation of application Ser. No. 109,956, filed Jan. 26, 1971 (now abandoned), which is a continuation-in-part of application Ser. No. 762,145, filed Sept. 24, 1968 (now abandoned).

Most fully synthetic fibres are difficult to dye because of their compact, hydrophobic nature. Thus, fully synthetic fibres, especially polyester fibres, must be dyed in the presence of a so-called carrier or in the pressure dyeing apparatus, and the dyeing time required may be up to several hours. The present invention relates to the dyeing of synthetic hydrophobic fibres or filaments and of textile materials made therefrom in an organic medium.

It has already been proposed to dye fully synthetic textile material, for example, polyester fabrics, in a solution of a dyestuff in methylenechloride, but this method yields only dyeings of unsatisfactory tinctorial depth and the dyeing operation takes too long.

It has also been proposed to dye films or fabrics of fully synthetic polymers with a solution of a dyestuff in an organic solvent, after having modified the surface of the material to be dyed by treatment with a chemical, for example, trichloroacetic acid.

For this purpose dimethylsulphoxide has already been proposed as a solvent, but only patchy dyeings are obtained with this solvent on polyester fabrics. Furthermore, it has been proposed to use solvent mixtures for dyeing polyester materials, but the dyestuff must be subsequently fixed on the fibre by a heat treatment at a high temperature. Finally, it has been proposed to dye polyester fibres or filaments having an especially low degree of crystallinity, as they are obtained as intermediates in the polyester manufacture, in high-boiling solvents.

The case of dyeing linear polyester filaments depends also very much on the degree of crystallinity of the filaments. The so-called textured fibres whose fibre structure has been subsequently modified by a physical treatment, for example, to achieve a crimp offset, moreover display fluctuations in their degree of crystallinity which make it very difficult to produce level dyeings.

It was therefore certainly unexpected that even fully stretched commercial fibres ready for weaving or previously worked up into, for example, fabrics and possibly also textured fibres or filaments of linear polyester could be satisfactorily dyed in the presence of a high-boiling solvent without impairing their texture.

Accordingly, the present invention provides a process for exhaustion-dyeing textile material of hydrophobic, fully synthetic linear polymers ready for weaving, especially of linear polyesters, wherein the dyeing is carried out in a homogeneous solution of one or several dyestuffs in a hydrophobic or hydrophilic solvent, or in a mixture of such solvents, at a temperature of at least 70° C, preferably at 100° C when a solvent is used and at a temperature of at least 70° C when a solvent mixture is used, preferably at the boiling point of the solvent.

Any sulphur atoms present in the solvent or solvent mixture are divalent or hexavalent.

As high-boiling solvents which must be inert to the fibres or filaments even at the dyeing temperature, that is to say which must not dissolve them, there may be mentioned, for example, the hydrophobic solvents which are at most only slightly miscible with water. To these belong the pure hydrocarbons, for example, white spirit (high-boiling petroleum ether) having a boiling point of at least 140° C, preferably of at least 170° C, oxygenous hydrocarbons, for example, n-amyl alcohol, isoamyl alcohol, isobutanol, dibutyl ether and especially chlorinated aliphatic hydrocarbons, for example, 1,1,1-trichloroethane, trichloroethylene and especially those which boil above 100° C, for example, perchloroethylene.

Water-miscible hydrophilic solvents are another class of preferred solvent, for example, dioxane, tetrahydrofuran, glycerolformal and glycolformal, also acetonitrile, tetrahydrofurfurylamine and pyridine; also high-boiling glycol derivatives for example, diacetone alcohol and especially ethyleneglycol monomethyl, ethyl and butyl ethers and diethyleneglycol monomethyl, or ethyl ethers, thiodiglycol, polyethyleneglycols insofar as they are liquid at room temperature, ethylene carbonate, γ-butyrolactone and especially the group of water-miscible active solvents boiling above 120° C, for example, N,N-dimethylformamide, N,N-dimethylacetamide, bis-(dimethylamido)-methane phosphate, tris-(dimethylamido)-phosphate, N-methylpyrrolidone, 1,5-dimethylpyrrolidone, N,N-dimethylmethoxyacetamide, tetrahydromethylenesulphono (sulpholan) and 3-methylsulpholan.

Among the hydrophilic solvents there are two preferred subgroups, namely (1) those which are capable of dissolving linear, spinnable fully synthetic polymers or polycondensates, for example, acrylonitrile polymers and (2) those which can be mixed with water in any desired proportion.

When hydroxyl groups are present in the solvent molecule, it also preferably contains at least one further function, for example, an ether or a mercapto group. For example, when nylon is dyed with an acid dyestuff, the solvent will of course be chosen so that it is insensitive to acids. When mixtures of solvents are used, the mixture may comprise two or more constituents of hydrophobic or hydrophilic nature.

When a mixture contains hydrophilic and hydrophobic solvents compatible with one another, the proportion of the hydrophilic solvent may be varied from nil to 100%. Among these mixtures those are preferred which consist of a chlorinated hydrocarbon, for example, trichloroethylene and perchloroethylene and not more than 50, preferably up to 20% by volume of an active solvent, especially amides of lower fatty acids, for example, N,N-dimethylformamide, N,N-dimethylacetamide or N-methylpyrrolidone.

Dyeing is carried out at a minimum temperature of 70° C, preferably of at least 100° C and advantageously at the boiling point of the organic liquor.

To prevent damage to the fibre a simple small-scale test is carried out prior to the dyeing operation to ascertain whether the fibre remains undissolved in the solvent under the dyeing conditions. Indications of the compatibility of solvents with various types of fibres will be found, for example, in the technical bulletin X-156 of Du Pont de Nemours S.A., Geneva, Switzerland, pages 14–15, edition August, 1962.

The boiling point of the solvent or solvent mixture used is preferably below 220° C to facilitate its subsequent removal by evaporation.

The present dyeing process is suitable for all types of synthetic fibres, for example, those in the groups of the acrylic or acrylonitrile fibres, of polyacrylonitrile of copolymers of acrylonitrile with other vinyl compounds, for example, acryl esters, acrylamides, vinylpyridine, vinylchloride or vinylidenechloride, copolymers or dicyanoethylene and vinyl acetate, or acrylonitrile block copolymers, fibres of polyurethanes, cellulose triacetate and 2½-acetate and especially polyamide fibres, for example, nylon 6, nylon 6,6 or nylon 11, and fibres of aromatic polyesters, for example, fibres of terephthalic acid + ethyleneglycol or 1,4-dimethylolcyclohexane, and copolymers of terephthalic or isophthalic acid and ethyleneglycol.

The textile materials to be dyed may be in loose form, in form of yarns of filaments or as knitted or woven fabrics. In loose form, or after having been wound over mechanical devices, it is immersed in a stationary bath, especially in a jigger, winch vat or dyeing vat for cross-wound bobbins or similar dyeing apparatus suitable for the purpose and dyed according to the nature of the material to be dyed.

Dyeing may be carried out in a dyeing machine or vessel that is connected with the ambient atmosphere (advantageously through a reflux condenser) or in a closed vessel, such as an autoclave, under atmospheric of superatmospheric pressure.

The dyestuffs suitable for use according to this invention are preferably representatives of the well-known group of water-insoluble dispersion dyestuffs, for example, monoazo, disazo or polyazo dyestuffs, anthraquinone, perinone, quinophthalone, nitroso, nitro, phthalocyanine, stilbene and methine dyestuffs, including the styryl, azamethine, polymethine and azostyryl dyestuffs. Soluble metal complex dyestuffs of the azo and formazan dyestuff types are also suitable.

It is, however, also possible to use other types of dyestuffs, for example, vat dyes in the unreduced state, provided they are soluble in one of the solvents mentioned above.

Suitable dyestuffs are, for example, halogenation products of 1,5-dihydroxy-4,8-diaminoanthraquinone such, for example, as 2- or 3-bromo-1,5-dihydroxy-4,8-diaminoanthraquinone, 3,7-dibromo-1,5-dihydroxy-4,8-diaminoanthraquinone; furthermore 1,4-diamino-2,3-dichloro-anthraquinone, 1-amino-2-phenoxy-4-hydroxyanthraquinone, 1-amino-2-phenylmercapto-4-hydroxyanthraquinone, 1-amino-2-(β-hydroxyethyloxy)-4-hydroxyanthraquinone and 1-amino-2-(β-methoxyethyloxy)-4-hydroxyanthraquinone, 1,5-dihydroxy-4,8-diamino-2- or -3-(3' methoxy-4'-hydroxyphenyl)-anthraquinone, 1,5-dihydroxy-4,8-diamino-2- or 3-(4'-hydroxy- and/or -4'-methoxyphenyl)-anthraquinone, 1,5-dihydroxy-4,8-diamino-2- or -3-(4'-hydroxy-2'-methylphenyl)-anthraquinone, 1,5-dihydroxy-4,8-diamino-2- or -3-(4'-hydroxyphenyl)-6- or -7-bromoanthraquinone, 1,5-dihydroxy-4,8-diamino-2-or -3-(4'-hydroxy-3'- or -2'-bromophenyl)-anthraquinone and 1,5-dihydroxy-4-amino-8-acetoxyethylamino-2- or -3-(4'-hydroxyphenyl)-anthraquinone, 1,4-diamino-2,3-anthraquinone-dicarboximide, 1-hydroxy-4-amino-2,3-anthraquinone-dicarboximide, 1,4-diaminoanthraquinone-2,3-dicarboxylic acid-β-hydroxyethylimide, 1,4-diaminoanthraquinone-2,3-dicarboxylic acid-γ-methoxy-propylimide, as well as the dyestuffs of the formulae

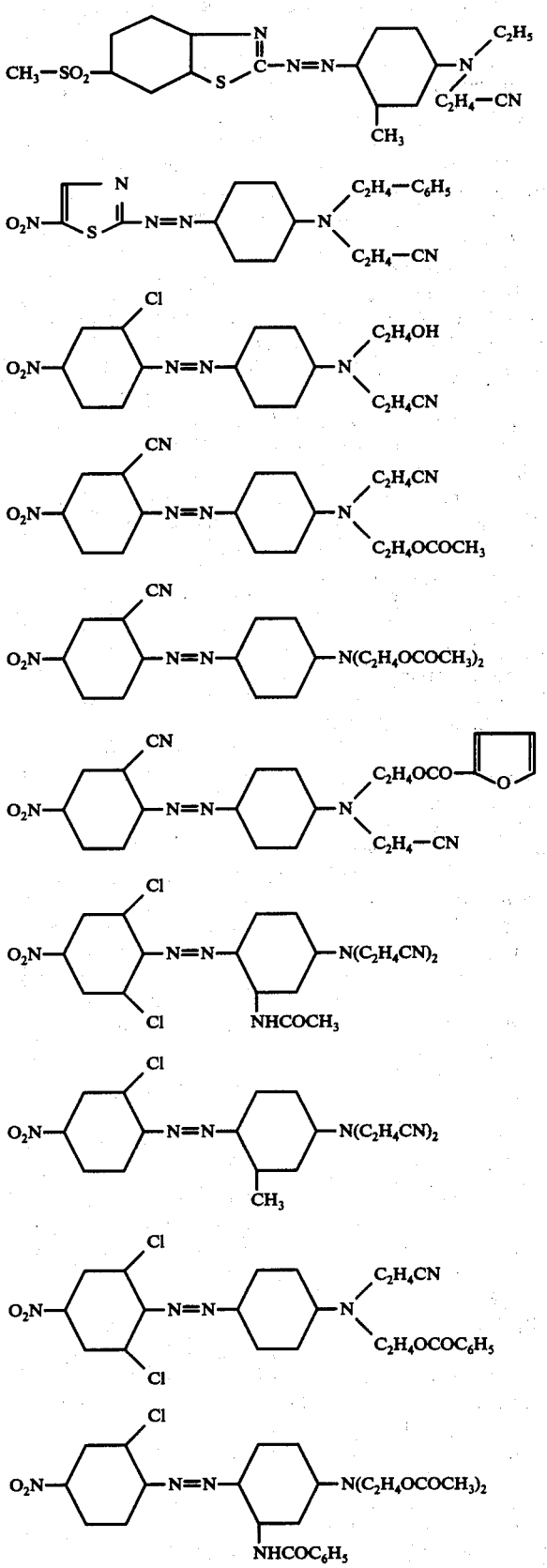

-continued

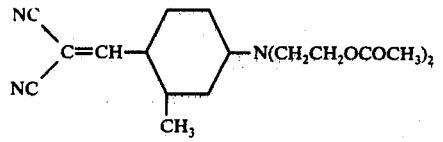

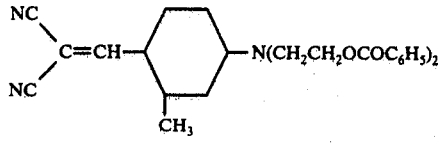

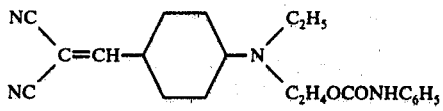

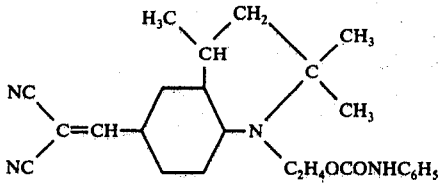

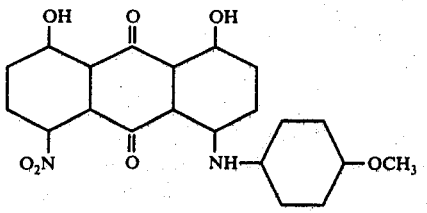

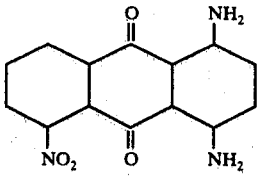

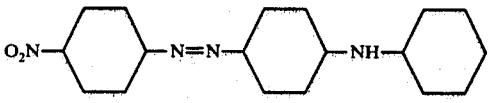

and

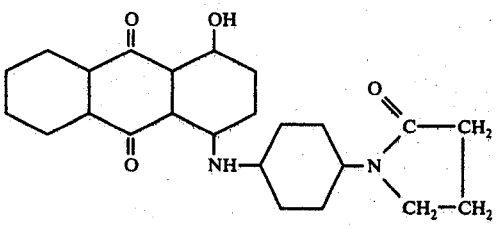

One advantage of the dyeing process of this invention over conventional dyeing with dyestuffs dispersed in water is that it is possible to use unconditioned dyestuffs, whereas for conventional dyeing from an aqueous liquor a specially conditioned dyestuff preparation is needed to facilitate dispersion in water.

When the desired tinctorial strength has been reached, the dyed material is taken out of the dyebath and any solvent adhering to it is removed with steam or with a current of hot air. A high temperature treatment to fix the dyestuff on the fibre, on the other hand, is unnecessary.

The following dyestuff illustrates the invention. Unless otherwise indicated, parts and percentages are by weight:-

EXAMPLE 1

0.1 Part of the dyestuff of the formula

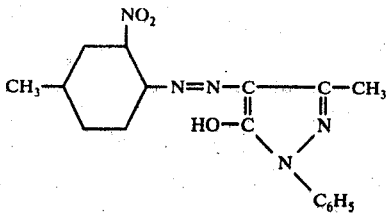

in the form of a concentrated dyestuff powder is dissolved at the boil in perchloroethylene and the solution is then cooled to about 100° C. 2.5 Parts of dry, not previously treated textured crimped polyester yarn are then added and dyeing is performed at a goods-to-liquor ratio of 1 : 64 in 100 parts of solvent mixture for 45 minutes at the boil (121.2° C) in a boiler equipped with reflux condenser, without any further additives; the evaporating solvent is recovered by distillation under reflux. The whole is then cooled for 15 minutes and the dyed yarn wrung out and dried in a current of warm air to free it from the dye liquor.

To achieve a brilliant dyeing the dyed yarn is then soaped in an aqueous solution containing per litre 2 g of the adduct of about 9 mols of ethylene oxide with 1 mol of nonylphenol for 30 minutes at the boil, then rinsed in water and dried.

The yarn is dyed a brilliant yellow tint. The dyeing operation did not impair the texturing of the polyester yarn.

EXAMPLE 2

0.1 Part of the dyestuff 1-amino-2-(β-hydroxyethyl)-4-hydroxyanthraquinone is dissolved at the boil in perchloroethylene and the solution coded to about 100° C. Then 2.5parts of dry, not previously treated textured polyester crimp yarn are added and dyed at a goods-to-liquor ratio of 1 : 64 in 100 parts of solvent mixture for 45 minutes at the boil (121.2° C) without any further additive, as described in Example 1. The whole is then cooled for 15 minutes and the dyed yarn freed from the adhering dyebath on the centrifuge and, without further drying, soaped in an aqueous bath containing per liter 3 g of an adduct of about 9 mols of ethylene oxide with 1 mol of nonylphenol for 30 minutes at the boil to produce the desired brilliant shade. The yarn is then rinsed in water and dried.

A billiant pink dyeing is obtained. The texturing of the polyester yarn is not affected by the dyeing operation.

EXAMPLE 3

0.1 Part of the dyestuff 1,5-dihydroxy-4,8-diamino-3,7-dibromoanthraquinone is dissolved at the boil in perchloroethylene and the solution is cooled to about 100° C, then 2.5 parts of not previously treated textured polyester tricot fabric are immersed in the solution and dyed at a goods-to-liquor ratio of 1 : 64 in 100 parts of perchloroethylene for 45 minutes at the boil (121.2° C), without any further additives, as described in Example 1, and is then further treated according to Example 1.

The fabric is dyed a brilliant, non-stripy blue shade. The texturing of the polyester fabric is not affected.

EXAMPLE 4

A solution of 1 g of the dyestuff of the formula

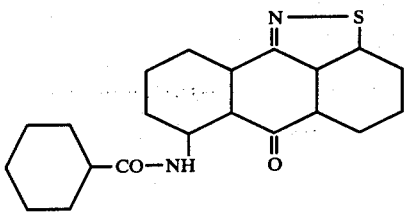

per 1 liter of dibutyl ether is heated to the reflux temperature and then a polyester fabric is dyed in it at a goods-to-liquor ratio of 1 : 80 for 1 hour at an internal temperature of 142° C. A medium strong, brilliant yellow dyeing is obtained.

EXAMPLE 5

A solution of 4 g of the dyestuff 2,6-dichloro-4-nitro-4'-(N- methyl-N-β-hydroxyethylamino)-azobenzene per 1 liter of white spirit (boiling at 180° C) is heated to reflux and a polyester fabric is dyed in it at a goods-to-liquor ratio of 1 : 50 for 15 minutes. A medium strong, brown shade is obtained.

EXAMPLE 6

0.2 Part of the dyestuff of the formula

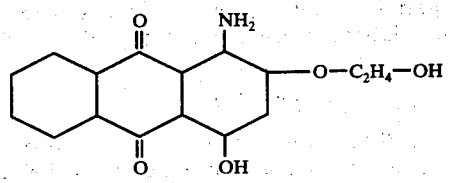

is dissolved in 100 parts of a mixture of 90% by volume of perchloroethylene and 10% by volume of n-methylpyrrolidone. To prepare this solution the dyestuff is first dissolved in cold N-methylpyrrolidone and the perchloroethylene is then added.

To obtain a complete solution of the dyestuff the liquor thus prepared is then heated to the boil and then, to immerse the textile material, cooled again to about 100° C. Then 2.5 parts of dry, not previously treated tricot fabric of textured nylon 6.6 (Holanca) is immersed in the liquor and dyed at a goods-to-liquor ratio of 1 : 64 for 20 minutes at the boil in a vessel equipped with reflux condenser (to recover the evaporating solvent) without any further additive. The whole is then cooled for 15 minutes and the dyed yarn freed from the dye liquor by being wrung out and dried in a current of warm air.

The resulting dyeing is then soaped for 15 minutes at the boil in an aqueous solution containing, per liter, 2 g of an adduct of 9 mols of ethylene oxide with 1 mol of nonylphenol, then rinsed in water and dried.

A brilliant pink shade is obtained which was fast, to light and washing. The texturing of the tricot fabric is not affected.

EXAMPLE 7

A solution of 0.1 part of the dyestuff of the formula

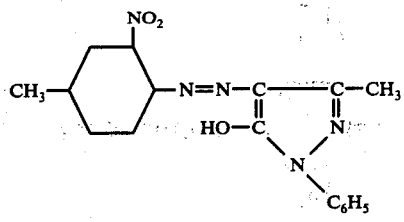

in 100 parts of a solvent mixture of 95% by volume of perchloroethylene and 5% by volume of furfuryl alcohol is prepared by first dissolving the dyestuff in cold furfuryl alcohol and then adding the perchloroethylene. The liquor thus obtained is then heated to the boil to dissolve the dyestuff, completely, and, to immerse the textile material in it, it is cooled again to about 100° C, then 2.5 parts of dry, not previously treated textured crimp polyester yarn are immersed in the dyebath; at a goods-to-liquor ratio of 1 : 64 the yarn is dyed for 45 minutes at the boil in a vessel equipped with reflux condenser (to recover the evaporating solvent by distillation), without any further additives and then cooled for 15 minutes and the dyed yarn is freed from the dyebath by being wrung out and dried in a current of warm air.

To achieve a brilliant shade the dyed yarn is then soaped for 30 minutes at the boil in an aqueous solution containing per liter 2 g of an adduct of about 9 mols of ethylene oxide with 1 mol of nonylphenol, then rinsed in water and dried.

A brilliant yellow shade is obtained. The texturing of the polyester yarn is not affected by the dyeing operation.

EXAMPLE 8

Dyeing is carried out as described in Example 7, except that the dyestuff 1-amino-2-(β-hydroxyethyl)-4-hydroxyanthraquinone and a solvent mixture of 95% by volume of perchloroethylene and 5% by volume of dioxane are used. A brilliant pink shade is obtained.

EXAMPLE 9

Dyeing is carried out as described in Example 8, except that the solvent mixture used consisted of 97% by volume of trichloroethylene and 3% by volume of pyridine. A brilliant pink shade is obtained.

EXAMPLE 10

Dyeing is carried out as described in Example 7, except with the use of the dyestuff 1,5-dihydroxy-4,8-diamino-3,7-dibromoanthraquinone and of a solvent mixture of 95% by volume of trichloroethylene and 5% by volume of n-butanol. A brilliant blue shade is obtained.

EXAMPLE 11

Dyeing is carried out as described in Example 10, except that a solvent mixture of 99,5% by volume of perchloroethylene and 0.5% by volume of dimethylacetamide is used.

A brilliant blue shade is obtained.

EXAMPLE 12

0.1 Part of the dyestuff 1,5-dihydroxy-4,8-diamino-3,7-dibromoanthraquinone, in the form of a concentrated dyestuff powder, is dissolved in 100 parts of a solvent mixture of 95% by volume of perchloroethylene and 5% by volume of N,N-dimethylacetamide. To prepare this solution the dyestuff is first dissolved in cold dimethylacetamide and the perchloroethylene is then added.

The dyebath prepared in this manner is heated to the boil to dissolve the dyestuff completely. To immerse the textile material in it the bath is then cooled again to about 100° C, then 2.5 parts of dry, not previously treated crimped polyester yarn (Crimplene) are added and dyed at a goods-to-liquor ratio of 1 : 64 for 20 minutes at the boil in a vessel equipped with reflux condenser (to recover the evaporating solvent by distillation), without any further additives. The yarn is then cooled for 15 minutes and freed from the dye liquor by being wrung out and dried in a current of warm air.

To achieve a brilliant shade and optimal fastness properties the dyed yarn is then soaped for 15 minutes at the boil in an aqueous solution containing per liter 2 g of an adduct of 9 mols of ethylene oxide with 1 mol of nonylphenol, then rinsed in water and dried. A brilliant blue shade, fast to light and washing, is obtained.

EXAMPLE 13

0.3 part of the dyestuff of the formula

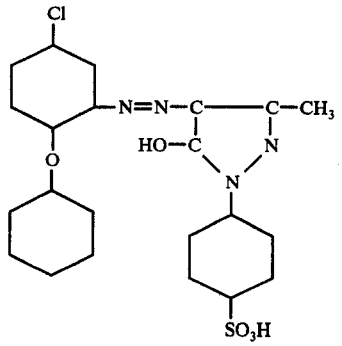

was dissolved in 16 parts N,N-dimethyl formamide, and the solution obtained was diluted with 145 parts perchloroethylene. 5 parts polyamide tricot were put into the bath which then was heated at 105° for 40 minutes. The dyed tricot was then removed from the bath and washed for 10 minutes in 160 parts perchloroethylene containing 1,5 parts of a commercial dry-cleaning detergent at 50° C. Finally the fabric was dried in a hot air current. The fabric was dyed in a level yellow shade with good fastness.

EXAMPLE 14

The same result as in Example 13 was obtained if the dyebath contained additionally one part acetic acid.

EXAMPLE 15

A level red shade was obtained according to the procedure of Example 13, when 4 parts of the dyestuff of the formula

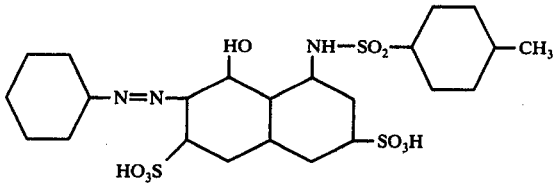

were used as dyestuff.

EXAMPLE 16

A level yellow shade was obtained according to the procedure of Example 13 when 4 parts of the dyestuff of the formula

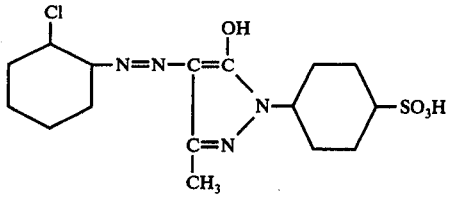

were used as dyestuff.

We claim:

1. A process for dyeing textile material of fully stretched linear polyester fibers by the exhaustion method, comprising the step of immersing textile material for at least about 15 minutes, at a temperature of at least 70° C in a non-aqueous homogeneous solution of a disperse dyestuff in a chlorinated aliphatic hydrocarbon solvent material having a boiling point of at least 100° C.

2. A process as claimed in claim 1, wherein dyeing is performed at a temperature of at least 100° C.

3. A process as claimed in claim 2, wherein dyeing is carried out at the boiling point of the organic solvent.

4. A process as claimed in claim 1, wherein dyeing is carried out in perchloroethylene.

5. A process as claimed in claim 1, wherein during the dyeing operation the evaporating solvent is recovered with the use of a reflux condenser.

6. A process as claimed in claim 1, wherein the material is dyed and then washed in an aqueous medium in the presence of an adjuvant.

7. A process as claimed in claim 1, wherein textured polyesters fibers are dyed.

* * * * *